US006488725B1

(12) United States Patent
Vincent et al.

(10) Patent No.: US 6,488,725 B1
(45) Date of Patent: Dec. 3, 2002

(54) FUEL ADDITIVES

(75) Inventors: Matthew William Vincent, South Wirral (GB); Paul Joseph Richards, South Wirral (GB); Stephen Leonard Cook, South Wirral (GB)

(73) Assignee: The Associated Octel Company Limited, London (GB)

( * ) Notice: Subject to any disclaimer, the term of this patent is extended or adjusted under 35 U.S.C. 154(b) by 0 days.

(21) Appl. No.: 09/608,292

(22) Filed: Jun. 30, 2000

Related U.S. Application Data

(63) Continuation of application No. PCT/GB99/00141, filed on Jan. 15, 1999.

(30) Foreign Application Priority Data

Jan. 15, 1998 (GB) ..... 9800869
Nov. 5, 1998 (GB) ..... 9824290

(51) Int. Cl.[7] ..... C10L 1/18; C10L 1/22; C10L 1/30

(52) U.S. Cl. ..... 44/358; 44/361; 44/362; 44/363; 44/365; 44/373; 44/385; 44/439; 44/450

(58) Field of Search ..... 44/354, 358, 362, 44/363, 361, 365, 375, 385, 439, 450, 403

(56) References Cited

U.S. PATENT DOCUMENTS 5,912,190 A * 6/1999 Barr et al. ..... 44/330
6,056,792 A * 5/2000 Barr et al. ..... 44/362

FOREIGN PATENT DOCUMENTS

| | | | |
|---|---|---|---|
| DE | 41 36 009 C | | 5/1993 |
| EP | 0 420 034 A | | 4/1991 |
| FR | 2 751 662 A | | 1/1998 |
| GB | 2 091 291 A | | 7/1982 |
| GB | 2 248 068 A | | 3/1992 |
| WO | WO 87 00193 A | | 1/1987 |
| WO | WO 92 20762 A | | 11/1992 |
| WO | WO 92 20765 A | | 11/1992 |
| WO | WO 96 11997 A | | 4/1996 |
| WO | WO 96 28524 A | | 9/1996 |
| WO | WO 96 34074 A | | 10/1996 |
| WO | WO 97 28358 A | | 8/1997 |
| WO | 9804655 | * | 2/1998 |

* cited by examiner

*Primary Examiner*—Cephia D. Toomer
(74) *Attorney, Agent, or Firm*—Bacon & Thomas

(57) ABSTRACT

The present invention relates to the use of fuel additives in the regeneration of particulate filter traps, e.g. diesel particulate filter traps. The invention further relates to fuel additives suitable for use in such a process.

24 Claims, No Drawings

FUEL ADDITIVES

This application is a continuation application of international application number PCT/GB99/00141, filed Jan. 15, 1999.

The present invention relates to the use of fuel additives in the regeneration of particulate filter traps, e.g. diesel particulate filter traps. The invention further relates to fuel additives suitable for use in such a process.

Products from the combustion or pyrolysis of hydrocarbon fuels include carbon monoxide, nitrous oxides ($NO_x$), unburned hydrocarbons and particulates. These particulates include not only those particulates which are visible as smoke emission, but also unburned and partially oxidised hydrocarbons from fuel and the lubricants used in engines.

Diesel particulates, i.e. particulates from the combustion or pyrolysis of diesel fuels, comprise inorganic ash (due to engine wear particles and combustion products of lubricant oil additives), sulfuric acid (due to sulfur in diesel fuel) and hydrocarbons from incomplete fuel combustion. The hydrocarbons are typically further divided into SOF (solvent organic fraction, i.e. material extractable in e.g. $CH_2Cl_2$) and a hydrocarbonaceous soot. Diesel smoke represents the obscuration of visible light by emissions of particulates (black smoke) and/or that arising from condensation of unburned or partially burned fuel (white smoke), typically during cold-start.

The emission of black smoke from diesel engines is a well-known problem. In addition to being unsightly, such emissions contain particulates and unburned hydrocarbons which are understood to represent a hazard to health. In particular, unburned hydrocarbons emitted into the atmosphere are irritant astringent materials. Further, in a problem recently highlighted for diesel fuels, emissions of particulate matter of less than 10 micrometers ($\mu$m) of principle dimension ("PM10 matter") are claimed to cause 10,000 deaths in England and Wales and 60,000 deaths in the USA annually (see New Scientist, March 1994, p.12). It is suspected that these smaller particles penetrate deeper into the lungs and adhere. Whilst the mucocilliary system is thought to have evolved to cope with airborne dusts, pollens etc., this does not cope well with smaller particles, especially those of less than 2.5 $\mu$m aerodynamic diameter.

Diesel fuels and diesel engines are especially prone to the emission of high levels of small size soot particulate matter in the exhaust gas. This is particularly so when the engine is highly loaded, worn or badly maintained. Particulate matter is also emitted from diesel engine exhausts when operated at partial load and these emissions are normally invisible to the naked eye.

Legislation now exists in many countries that is designed to control pollution from diesel engines. More demanding legislation is planned. A number of ways are being examined to enable diesel engines to run and comply with the developing legislation. Engine designs to give effective combustion within the cylinder are being developed. The engine designs developed to achieve low levels of emission are well known to those familiar with the art and examples of such designs are given in S.A.E. International Congress (February 1995) S.A.E Special Publication SP-1092. However, the drawbacks to engine management solutions such as these include cost, complexity and the poor capability for retrofitting.

As part of the process of reducing emissions from the diesel engine many modern engine designs use a technology known as Exhaust Gas Recirculation (E.G.R.) in which exhaust gas recycled in a controlled way to the intake of a diesel engine can contribute to the reduction of certain emissions species, mainly oxides of nitrogen (NOx). However, there are two significant drawbacks associated with the use of E.G.R. Firstly, particulates production and hence emission is increased, and, secondly, soot particles in the exhaust gas are recirculated within the engine. Thus, in addition to any emissions problems encountered, engines running with E.G.R. for prolonged periods of time can become choked with carbon particulates in areas such as the exhaust gas recycle lines and control valves, inlet ports and valves, and the piston top ring lands. Even the piston rings themselves can become choked in the ring grooves.

Also, carbon and other particles become deposited in the engine lubricant so causing its premature deterioration.

As an alternative and/or adjunct to means of reducing the production of particulates or other pollutants, various post-combustion treatments have been proposed. These include De-NOx catalysts, hydrocarbon oxidation catalysts and the use of particulate filters, especially diesel particulate filters (DPFs), capable of oxidising collected material. The use of DPFs is particularly desirable in the light of recent evidence to suggest that the mass of particulates emitted may be of less importance than the number of ultrafine particles (usually regarded as those having a diameter of 2.5 $\mu$m or less). Furthermore, DPFs can function without the need to further reduce fuel sulfur levels.

Particulate filter traps (also referred to as particulate filters or particulate traps) are well known to those familiar with the art. Some examples are discussed in "Advanced techniques for thermal and catalytic diesel particulate trap regeneration", S.A.E. International Congress (February 1985) S.A.E. Special Publication-42: 343–59 (1992) and S.A.E. International Congress (February 1995) S.A.E. Special Publication SP-1073 (1995). Diesel particulate filter traps exhibiting high efficiency for particles of aerodynamic diameter 10 $\mu$m and below have been demonstrated (Dementhon et al., SAE 972999).

A problem associated with the use of particulate filter traps is that of trap blockage which causes an increase in exhaust back pressure and a loss of engine efficiency and/or "chimney fires" resulting from sudden and intense burn off of soot from highly loaded traps.

Catalytic devices have been used to aid in trap oxidation. $NO_2$ is known as a powerful oxidant. Using a by-pass system it is possible to produce high concentrations of $NO_2$ in the exhaust gas when regeneration is required. However, these devices require a low sulphur fuel (<50 ppm) to avoid increased sulfate emissions when using this method. Also, low speed engine operation can cause carbonaceous deposits to form on the active parts of the diesel engine oxidation catalyst and so inhibit the effectiveness of the catalyst until a sufficiently high gas temperature is available to regenerate the catalyst active surface.

DPFs which feature 'washcoats' comprising metal ions capable of catalysing soot oxidation are also known in the art, see A Mayer et al. SAE 960138, R W McCabe and R M Sinkevitch SAE 870009 and B Engler et al. SAE 860007. These do offer improved regeneration under ideal or near-ideal conditions, but suffer the potential for blocking of the active sites by the coating of soot deposited under conditions adverse for regeneration.

A number of fuel additives have been proposed in an attempt to solve the problems inherent in the use of diesel particulate filters (see, for example, Miyamoto et al. SAE 881224; Martin et al. I. Mech. E. November 1990; Lepperhoff et al. SAE 950369; Rao et al. SAE 940458; Ise et al. SAE 860292; and Daly et al. SAE 930131) These additives serve to reduce the soot ignition temperature such that suitable conditions for trap regeneration (i.e. decrease in back pressure) occur at high frequency during normal driving. However, in general such additives also require the back-up of some active management system capable of triggering a regeneration following prolonged periods of abnormal use, such as idling. In this situation the additives serve to reduce the energy input required to initiate regeneration.

Iron-based additives are known for use in the regeneration of particulate filters and are described, for example, in WO-A-92/20762.

The use of alkali and alkaline earth metal-based additives for the regeneration of diesel particulate filters is described, for example, in WO-A-96/34074 and WO-A-96/34075.

The present invention seeks to provide improved fuel additives capable of the regeneration of particulate filter traps, e.g. diesel particulate filter traps. Key aspects of the additive in accordance with the invention are that it is fully effective in current day (i.e. EN590 specification) fuels and does not require reformulation of fuels, in particular to low sulphur content, but will function if such fuels are used. It will also not affect the operation of other devices, such as in particular hydrocarbon oxidation or NOx reduction catalysts.

It has now surprisingly been found that a mixture of (i) at least one iron-containing fuel soluble or fuel dispersible species and (ii) at least one alkaline earth group metal-containing fuel soluble or fuel dispersible species acts synergistically to improve the regeneration of a particulate filter (such as a diesel particulate filter) when added to the fuel prior to combustion.

According to a first aspect, the present invention thus provides a method of regenerating a particulate filter trap, e.g. a particulate trap used with a diesel engine, the method comprising adding to a fuel prior to or during combustion thereof a composition comprising at least one iron-containing fuel soluble or fuel dispersible species and at least one alkaline earth group metal-containing fuel soluble or fuel dispersible species, wherein the said alkaline earth group metal-containing species comprises strontium and/or calcium and wherein the ratio by weight of iron to said alkaline earth group metal is from 10:1 to 5:4.

Whilst not wishing to be bound by theory, it is believed that the fuel additive combination of the invention serves to enhance the ease with which oxidation of the trapped hydrocarbonaceous soot may be initiated, thereby effecting trap regeneration.

As used herein, the term "regeneration" or "regenerating" means cleaning a particulate trap so that it contains minimal or no particulates. The usual regeneration process includes burning off the trapped particulates in and on the particulate trap. Regeneration of the trap is accompanied by a reduction in pressure drop across the trap.

In the case of improved regeneration of a particulate trap, regeneration may occur with greater frequency and/or to a greater degree (i.e. a greater drop in exhaust pressure is observed). Alternatively, regeneration may occur at a lower exhaust pressure for a given engine condition, or may occur over a wider range of engine conditions.

According to a second aspect, the invention provides the use of a composition comprising at least one iron-containing species and at least one alkaline earth group metal-containing species as hereinbefore defined as a fuel additive for the regeneration of a particulate filter trap, e.g. a diesel particulate filter trap.

Viewed from a third aspect, the invention provides a fuel-additive composition comprising at least one iron-containing fuel soluble or fuel dispersible species in synergistic combination with at least one alkaline earth group metal-containing fuel soluble or fuel dispersible species, optionally together with a fuel-soluble carrier liquid miscible in all proportions with the fuel wherein the said alkaline earth group metal-containing species comprises strontium or is a mixture of strontium and calcium and wherein the ratio by weight of iron to said alkaline earth group metal is from 10:1 to 5:4 or a fuel additive composition consisting essentially of at least one iron-containing fuel soluble or fuel dispersible species in synergistic combination with at least one alkaline earth group metal-containing fuel soluble or fuel dispersible species, optionally together with a fuel-soluble carrier liquid miscible in all proportions with the fuel wherein the said alkaline earth group metal-containing species comprises calcium and wherein the ratio by weight of iron to said alkaline earth group metal is from 10:1 to 5:4.

Preferably, the fuel additive composition of the invention consists essentially of at least one iron-containing species, preferably a single iron-containing species, and at least one alkaline earth group metal-containing species, preferably a single alkaline earth group metal-containing species, optionally together with a fuel-soluble carrier liquid miscible in all proportions with the fuel.

Particularly preferably the composition of the invention is substantially free from any other metal-containing species, for example any other transition metal or alkali metal-containing species. Thus, it is preferable that the iron and alkaline earth group metal-containing species are the sole metal-containing species present in the composition.

Concentrations of the metal-containing species in the additive composition may range from 5 to 90% by weight, preferably 10 to 90% by weight. As high a concentration as may practically be achieved is preferred. Practical considerations include solubility of the metal-containing species and in particular the viscosity of the resulting concentrate. Compositions containing from 40 to 60% by weight of the metal-containing species are often preferred as typically offering a good compromise between concentration and viscosity.

Many types of particulate traps are known to those skilled in the art and may be used without departing from the scope of the invention. These include, as nonlimiting examples, 'cracked wall' and 'deep-bed' ceramic types and sintered metal types. Whilst the invention is suitable for use with all particulate traps, optimum dose rate of the fuel additive in accordance with the invention will vary according to a number of factors, such as engine type, design and duty and the design and materials of construction of the trap. Optimum dose rate can be readily determined by those skilled in the art. Optimum dose rate will in general be lower for DPFs which feature additional means of obtaining regeneration such as soot-oxidant washcoats, energy input or deliberate introduction of oxidant species, such as $NO_2$.

Examples of particulate filter traps suitable for use in the method of invention include those fabricated from a cordierite monolith, from sintered silicon carbide, from electroplating metal onto a foam substrate and subsequent combustion of the foam, from sintered or pulverised metal and those fabricated from an aluminosilicate fibre. Cordierite or silicon carbide DPFs are preferred.

Preferably, the total concentration of the metal-containing species, more preferably the total concentration of the metal, added to the fuel prior to combustion is 100 ppm or less, more preferably 50 ppm or less, e.g. 30 ppm.

It is particularly important to minimise the total dose of additive such as to minimise build-up of additive ash in the filter. For use with a particulate filter trap of the 'cracked-wall' type, a preferred total concentration of the iron and alkaline earth group metal-containing species, preferably the total concentration of iron and alkaline earth metals, in the fuel prior to combustion is 20 ppm or less. For use with a particulate filter trap of the 'deep-bed' type, such as one constructed from 3M Nextel™ fibre, a preferred total concentration of the metal-containing species, preferably the total concentration of metal, in the fuel immediately prior to combustion is 20 ppm or less, more preferably 10 ppm or less.

The precise nature of the iron-containing and alkaline earth metal-containing compounds for use in the invention is not important, save that these are fuel soluble or dispersible and preferably fuel stable. Suitable compounds will be known or can be readily determined by those skilled in the art.

The coordination chemistry relevant to the solubilisation of transition metals, including iron, in hydrocarbon solvents, e.g. diesel fuel is well known to those skilled in the art (see e.g. WO-A-87/01720 and WO-A-92/20762).

Preferred iron-containing compounds for use in the invention include organometallic complexes of iron, such as ferrocene, substituted ferrocenes, iron naphthenate, iron succinates, stoichiometric or over-based iron soaps (carboxylate or sulfonate), iron picrate, iron carboxylate and iron β-diketonate complexes. Particularly preferred iron-containing compounds include iron carboxylates, for example iron tris(2-ethylhexanoate).

Preferably, the iron-containing species may be an iron α-poly(alkenyl) succinate. Most preferably, the iron-containing compound is ferrocene.

A wide range of so-called "substituted ferrocenes" are known and may be used in the present invention (see e.g. Comprehensive Organic Chemistry, Eds. Wilkinson et al., Pergamon 1982, Vol. 4:475–494 and Vol. 8:1014–1043). Substituted ferrocenes for use in the invention include those in which substitution may be on either or both of the cyclopentadienyl groups. Suitable substituents include, for example, one or more $C_{1-5}$ alkyl groups, preferably $C_{1-2}$ alkyl groups.

Particularly suitable alkyl-substituted-dicyclopentadienyl iron complexes (substituted ferrocenes) include cyclopentadienyl(methylcyclopentadienyl) iron, bis(methylcyclopentadienyl) iron, bis(ethylcyclopentadienyl) iron, and bis-(1,2-dimethylcyclopentadienyl) iron.

Other suitable substituents which may be present on the cyclopentadienyl rings include cycloalkyl groups such as cyclopentyl, aryl groups such as tolylphenyl, and acetyl groups, such as present in diacetyl ferrocene. A particularly useful substituent is the hydroxyisopropyl group, resulting in (α-hydroxyisopropyl)ferrocene. As disclosed in WO-A-94/09091, (α-hydroxyisopropyl)ferrocene is a room temperature liquid.

As a result of a combination of their solubility, stability and high iron content, the substituted ferrocenes are particularly preferred iron compounds for use in the invention. Ferrocene itself is an especially preferred iron compound on this basis.

Suitable stoichiometric iron carboxylates for use in the invention include the so-called 'drier-iron' species, such as iron tris(2-ethylhexanoate) [19583-54-1]. These are also highly preferred as providing a cost-effective source of fuel-soluble iron. As nonlimiting examples, the products sold as 'Ferrosol T6™' and 'Ferrosol T9™' by Centec of Middlewich, Cheshire have been found to be suitable. The advantage of such species is the high concentration of fuel-soluble iron that is so made available, reducing the overall package size required to achieve a given treat-rate of the metal.

Other organometallic complexes of iron may also be used in the invention, to the extent that these are fuel soluble and stable. Such complexes include, for example, iron pentacarbonyl, di-iron nonacarbonyl, (1,3-butadiene)-iron tricarbonyl, (cyclopentadienyl)-iron dicarbonyl dimer and the diisobutylene complex of iron pentacarbonyl. Salts such as di-tetralin iron tetraphenylborate ($Fe(C_{10}H_{12})_2(B(C_6H_5)_4)_2$) may also be employed.

The iron compounds for use in the invention need not feature iron-carbon bonds in order to be fuel soluble and stable. Thus, for example, overbased soaps including iron stearate, iron oleate and iron naphthenate may be used. Methods for the preparation of metal soaps are described in The Kirk-Othmer Encyclopedia of Chemical Technology, 4th Ed, Vol. 8:432–445, John Wiley & Sons, 1993.

Iron complexes not featuring metal-carbon bonds and not prepared using carbonation may also be used in the invention provided these are adequately fuel soluble and stable. Examples include complexes with β-diketonates, such as tetramethylheptanedionate.

Iron complexes of the following chelating ligands are also suitable for use in the invention:

- aromatic Mannich bases such as those prepared by reaction of an amine with an aldehyde or ketone followed by nucleophilic attack on an active hydrogen-containing compound, e.g. the product of the reaction of two equivalents of (tetrapropenyl)phenol, two of formaldehyde and one of ethylenediamine;
- hydroxyaromatic oximes, such as (polyisobutenyl) salicylaldoxime. These may be prepared by reaction of (polyisobutenyl)phenol, formaldehyde and hydroxylamine;
- Schiff bases such as those prepared by condensation reactions between aldehydes or ketones (e.g. (6-t-butyl) salicylaldehyde) and amines (e.g. dodecylamine). A tetradentate ligand may be prepared using ethylenediamine (half-equivalent) in place of dodecylamine;
- β-substituted phenols, such as 2-substituted-8-quinolinols, for example 2-dodecenyl-8-quinolinol or 2-N-dodecenylaminomethylphenol;
- α-substituted phenols, such as those wherein the substituent is —$NR_2$ or —SR in which R is a long chain (e.g. 20–30 C atoms) hydrocarbyl group. In the case of both α- and β-substituted phenols, the aromatic rings may beneficially be further substituted with hydrocarbyl groups, e.g. lower alkyl groups;
- carboxylic acid esters, in particular succinic acid esters such as those prepared by reaction of an anhydride (e.g. dodecenyl succinic anhydride) with a single equivalent of an alcohol (e.g. triethylene glycol);
- acylated amines. These may be prepared by a variety of methods well-known to those skilled in the art. However, particularly useful chelates are those prepared by reaction of α-alkenyl substituted succinates, such as dodecenyl succinic anhydride, with an amine, such as N,N'-dimethyl ethylene diamine or methyl-2-methylamino-benzoate;
- amino-acids, for example those prepared by reaction of an amine, such as dodecylamine, with an α,β-unsaturated ester, such as methylmethacrylate. In cases where a primary amine is used, this may be subsequently acylated, such as with oleic acid or oleyl chloride;
- hydroxamic acids, such as that prepared from the reaction of hydroxylamine with oleic acid;

linked phenols, such as those prepared from condensation of alkylated phenols with formaldehyde. Where a 2:1 phenol:formaldehyde ratio is used the linking group is —$CH_2$—. Where a 1:1 ratio is employed, the linking group is —$CH_2OCH_2$—;

alkylated, substituted pyridines, such as 2-carboxy-4-dodecylpyridine;

borated acylated amines. These may be prepared by reaction of a succinic acylating agent, such as poly (isobuylene)succinic acid, with an amine, such as tetraethylenepentamine. This procedure is then followed by boronation with a boron oxide, boron halide or boronic acid, amide or ester. Similar reactions with phosphorus acids result in the formation of phosphorus-containing acylated amines, also suitable for providing an oil-soluble iron chelate for use in the invention;

pyrrole derivatives in which an alkylated pyrrole is substituted at the 2-position by —OH, —$NH_2$, —NHR, —$CO_2H$, —SH or —C(O)H. Particularly suitable pyrrole derivatives include 2-carboxy-t-butylpyrroles;

sulfonic acids, such as those of the formula $R^1SO_3H$, where $R^1$ is a $C_{10}$ to about $C_{60}$ hydrocarbyl group, e.g. dodecylbenzene sulfonic acid.

Suitable iron picrates for use in the invention include those described in U.S. Pat. Nos. 4,370,147 and 4,265,639.

Other iron-containing compounds for use in the invention include those of the formula $M(R)_x.nL$ wherein M is an iron cation; R is the residue of an organic compound RH in which R is an organic group containing an active hydrogen atom H replaceable by the metal M and attached to an O, S, P, N or C atom in the group R; x is 2 or 3; n is 0 or a positive integer indicating the number of donor ligand molecules forming a dative bond with the metal cation; and L is a species capable of acting as a Lewis base.

Preferred examples of the alkaline earth metal compounds that may be used in the invention are the organometallic complexes of the Group II metals, such as the phenoxides, β-diketonates and stoichiometric or over-based soaps (whether carboxylate or sulfonate)

Preferably, the organometallic complex of the Group II metals is of the formula $M(R)_2.nL$ where M is an alkaline earth metal cation; and R, n and L are as hereinbefore defined.

Preferably, in the compounds of formula $M(R)_x.nL$ and $M(R)_2.nL$, R is the residue of an organic compound RH in which H represents an active hydrogen atom reactive with the metal M and attached either to a heteroatom selected from O, S and N in the organic group R, or to a carbon atom, that heteroatom or carbon atom being situated in the organic group R close to an electron withdrawing group, e.g. a heteroatom or a group consisting of or containing O, S or N, e.g. a carbonyl (>C═O), thione (>C═S) or imide (>C═NH) group, or an aromatic ring, e.g. phenyl. When the electron withdrawing group is a heteroatom or group, this may be present in either an aliphatic or alicyclic group which, when the active hydrogen group is an >NH group, may optionally contain that group as part of a heterocyclic ring.

Preferably, n is up to 5. Typically, to ensure oil solubility, the value of n will be from 1 to 4.

R and L may be present in the same molecule, in which case n can be and often is 0 and L is a functional group capable of acting as a Lewis base.

Suitable iron and/or Group II metal complexes include those derived from a β-diketone of the formula $$R^1C(O)CH_2C(O)R^2$$

wherein $R^1$ and $R^2$ independently represent $C_1$–$C_5$ alkyl or substituted alkyl groups, e.g. halo-, amino-, alkoxy- or hydroxyalkyl-, $C_3$–$C_6$ cycloalkyl, benzyl, phenyl or $C_1$–$C_5$ alkylphenyl, e.g. tolyl, xylyl, etc.

Suitable β-diketones include hexafluoroacetylacetone: $CF_3C(O)CH_2C(O)CF_3$ (HFA); and 2,2,6,6-tetramethylheptane-3,5-dione: $(CH_3)_3CC(O)CH_2C(O)C(CH_3)_3$.

If the active hydrogen atom is attached to an O atom in the organic compound RH, then suitable compounds include phenolic compounds containing from 6–30 carbon atoms, preferably substituted phenols containing from 1–3 substituents selected from alkyl, alkylaminoalkyl, and alkoxy groups of 1–8 carbon atoms, e.g. cresols, guiacols, di-t-butylcresols, dimethylaminomethylenecresol. The substituted phenols are particularly preferred.

Especially preferred compounds wherein the hydrogen atom is attached to an O atom in the organic compound RH are those derived from the reaction of a metal hydroxide or other alkaline earth metal source with an alkyl or alkenyl substituted succinic anhydride or the hydrolysis product. Typically such anhydrides are those prepared by reaction of oligomerised isobutenes or other simple olefins with maleic anhydride. A wide variety of such alkyl or alkenyl substituted succinic anhydrides and a range of techniques for their preparation are known to those skilled in the art. In general, a high molecular weight poly(isobutene) substituent provides the resulting complex with good hydrocarbon solubility at the cost of lower metal content. We have found the alkenyl substituted succinic anhydride derived from the thermal reaction of BP Napvis X-10™ with maleic anhydride to give a good compromise between hydrocarbon solubility and metal content.

A more preferred class of alkaline earth metal compounds are the α-poly(alkenyl) substituted succinate salts and complexes thereof. Particularly preferred is strontium bis poly (butenyl) succinate prepared from BP Napvis™ X-10 PIB.

Reaction products of metal hydroxides, such as strontium hydroxide, with hemi-esters of the above described poly (alkenyl) succinates are also useful in the invention. A particularly preferred hemi-ester is that prepared from the reaction product of maleic anhydride with BP Napvis X-10™ and isopropyl alcohol charged in small excess (e.g. 1.1 equivalents) to the amount of succinate groups present in the sample as determined by methods well known in the art.

If the active hydrogen is attached to a N atom in the organic compound RH, then suitable compounds are heterocyclic compounds of up to 20 carbon atoms containing a —C(Y)—NH— group as part of the heterocycle, Y being either O, S or >NH. Suitable compounds include succinimide, 2-mercaptobenzoxazole, 2-mercaptopyrimidine, 2-mercaptothiazoline, 2-mercaptobenzimidazole and 2-oxobenzoxazole.

As used herein, the term "species capable of acting as a Lewis base" includes any atom or molecule that has one or more available electron pairs in accordance with the Lewis acid-base theory.

In more detail, L can be any suitable organic electron donor molecule (Lewis base), the preferred ones being N-methyl-pyrrolidinone (NMP), bis(2-methoxyethyl) ether (diglyme), N,N'-dimethyl formamide, dimethylpropylidene urea (DMPU) and dimethylinidazolidinone (DMI). Other possible ligands include hexamethylphosphoramide (HMPA), tetramethylethylenediamine (TMEDA), dimethylsulphoxide (DMSO), diethyl ether ($Et_2O$), 1,2-(dimethoxyethane (glyme), dioxane and tetrahydrofuran. Where R and L are present in the same molecule, L is a functional group capable of acting as a Lewis base donor, preferred ones being dimethylaminomethyl (—$CH_2NMe_2$), ethyleneoxy (—$OCH_2CH_2O$—), poly(ethyleneoxy), ethyleneamine (—$N(R)CH_2CH_2N(R)$—), carboxy (—$CO_2H$), 1-(2-hydroxyethyl)-2-pyrrolidinone (—$OCH_2CH_2NCO(CH_2)_2CH_2$) and ester (—$CO_2CH_2$—). It is to be understood that these listings are by no means exhaustive and other suitable organic donor ligands or functional groups (Lewis bases) may be used.

In relation to any of the chelating ligands herein described it will be readily understood by those skilled in the art that the presence on the ligand of bulky substituents, e.g. t-butyl groups, or long alkyl chains, e.g. polyisobutylene, serves to improve the solubility of the metal chelate in diesel fuel. However, this improvement in solubility is at the cost of a reduced metal concentration in the additive.

The alkaline earth metals used in the present invention are strontium and calcium, particularly strontium. Mixtures of calcium and strontium are also preferred. The preferred source of the metal will typically be the hydroxide or oxide.

Different ratios of iron to alkaline earth metal may be employed. For particularly high sulfur-content fuels a higher level of the alkaline earth metal-containing species, preferably a higher level of the alkaline earth metal, may be beneficial. For standard European diesel fuel (300 ppm typical, 500 ppm specified) it is preferred to use a larger amount of iron.

In the fuel additive compositione for use in accordance with the invention the ratio by weight of iron-containing species to alkaline earth metal-containing species is from 10:1 to 5:4, e.g. 6:1 to 5:4, particularly preferably about 4:1.

In the fuel additive compositions of the invention the ratio by weight of iron to strontium, calcium or a mixture thereof, will be from 10:1 to 5:4, e.g. 6:1 to 5:4, particularly preferably about 4:1.

The fuel additives of the invention may be dosed to the fuel at any stage in the fuel supply chain. Preferably, each additive is added to the fuel close to the engine or combustion systems, within the fuel storage system for the engine or combustor, at the refinery, distribution terminal or at any other stage in the fuel supply chain.

The fuel additives according to the invention may be added as part of a package to the fuel prior to combustion. This may be done at any stage in the fuel supply chain (for example, at the refinery or distribution terminal) or may be added via a dosing device on-board, the vehicle, either to the fuel or even separately direct into the combustion chamber or inlet system.

The term "fuel" includes any hydrocarbon that can be used to generate power or heat. The term also covers fuel containing other additives such as dyes, cetane improvers, rust inhibitors, antistatic agents, antioxidants, reodorants, gum inhibitors, metal deactivators, de-emulsifiers, upper cylinder lubricants, and anti-icing agents. Preferably, the term covers diesel fuel.

The term "diesel fuel" means a distillate hydrocarbon fuel or for compression ignition internal combustion engines meeting the standards set by BS 2869 Parts 1 and 2 as well as fuels in which hydrocarbons constitute a major component and alternative fuels such as ethanol or diesel containing ethanol or other oxygenates, diesel/water emulsions, rape seed oil and rape oil methyl ester.

The present invention therefore relates to additives for liquid hydrocarbon fuel, and fuel compositions containing them. More particularly, the present invention relates to additives for diesel fuels.

Whilst the fuel additives described may be added directly to the fuel, either external to the vehicle or by using an on board dosing system, alternatively these are first formulated as a fuel additive composition or concentrate containing the iron and alkaline earth metal-containing species along with other additives, such as detergents, anti-foams, dyes, cetane number improvers, corrosion inhibitors, gum inhibitors, metal deactivators, de-emulsifiers, upper cylinder lubricants, anti-icing agents, anti-oxidants, pour point depressants, reodourants, cloud point depressants, wax anti-settling additives, cold flow improvers, etc. in an organic carrier miscible with the fuel.

Suitable organic carriers for the formulations include aromatic hydrocarbon solvent fractions such as Shellsol AB™, Shellsol R™ and Solvesso 150™. De-aromatised solvent fractions such as Shellsol D70™ are also suitable. Other suitable carrier liquids miscible with diesel and other similar hydrocarbon fuels will be readily apparent to those skilled in the art.

The synergistic combination of iron and at least one alkaline earth metal in accordance with the invention offers a number of advantages. Firstly, regeneration of the trap is enhanced such that there is a lower average back pressure across the trap. Thus, the invention provides additives for diesel and other hydrocarbon fuels that give an overall emissions benefit to the environment on combustion by improving the oxidation of particulates within trap systems. When a fuel containing the composition of the invention is burned, any trapped material exhibits a reduced ignition temperature and oxidation of the trapped material is enhanced, when compared to that of fuel burned without the composition of the present invention. The burning of soot and other hydrocarbons from the surfaces of a trap therefore provides a way to regenerate the filter and so prevent the unacceptable clogging of particulate traps.

Secondly, regeneration of the trap may be caused to occur with greater reliability and frequency across a wide range of engine operating conditions and at the lowest possible loading of particulate material within the trap. This results in minimum average pressure drop across the trap and can be detected, for example, by logging trap back pressure at regular discrete intervals whilst running the engine under steady conditions and determining the standard deviation as well as the mean of the back pressure readings. Further, regeneration with less carbon in the trap results in lower thermal stresses arising from the exothermic regeneration.

A further advantage of the additive of the invention is that this requires minimum adjustment to engine operating parameters (e.g. injection timing) and/or minimum energy input to produce a 'forced,' regeneration, whether operating within or outside an envelope wherein spontaneous regenerations are likely to be encountered.

Furthermore, the additive of the invention achieves trap regeneration at a dose level which provides minimum inorganic ash. Since inorganic ash is predominantly retained within the filter and inevitably leads to an increase in filter base back-pressure at given engine duty (e.g. idle) with time, it is important that its production should be minimised.

As mentioned above, the composition of the present invention is effective in promoting and sustaining combustion of trapped particles in the trap. Another key advantage is that this provides for simpler, safer and less costly traps by enabling less frequent, less intense or less energetic regeneration, whether the heat required for the regeneration is provided by the exhaust gas or through some external mechanism. The composition of the invention may also be used in low dosage amounts.

In some instances, the combustion of fuel containing the composition of the present invention enables engines to be run at a full load and at a fractional load with a suitable trap arrangement and in doing so a self regenerating mechanism is initiated.

In some instances, when an engine and associated particulate trap are run burning a fuel containing the composition of the present invention there are provided two broad modes of trap function. First, a soot and particulate trapping stage associated with a minor clogging function can be observed. This is then followed by an automatic burn off or self-regeneration function. Trap conditions which favour self regeneration are influenced by particulate size and formation, the composition of unburned hydrocarbons, the back pressure and composition of the exhaust gas in the exhaust system. These discrete functions of trapping with the invention is that it is capable of functioning acceptably in a wide range of engine types and with a wide range of fuels, including fuels with realistic sulphur concentrations. Furthermore, the additive provides for low fuel treatment costs.

The present invention will now be described by way of the following non-limiting examples:

EXAMPLES 1–6

Diesel Particulate Filter Tests

The engine design used to generate test data was four cylinder, in-line with a single overhead camshaft operating two valves per cylinder. The engine was of the indirect injection (IDI) type, employing a Ricardo Comet type pre-chamber design. The total swept volume of the engine was 1905 $cm^3$. The engine was naturally aspirated and had a 23.5:1 compression ratio. The engine was fitted with a Roto-Diesel fuel pump and Bosch pintle type fuel injectors.

The engine was mounted on a pallet arrangement which was equipped with appropriate heat exchangers, electrical connections and connectors for instrumentation signals. This pallet arrangement was then connected to the engine test bench. The engine dynamometer was a Froude AG150 eddy current machine controlled by the CP Engineering Cadet system. The engine temperatures were controlled automatically by suitable 3-term controllers integrated into the secondary coolant system supplies. The test bench was controlled and data logged using a CP Engineering Cadet system.

The engine exhaust system was modified to allow ready interchange of a centre section which could incorporate a selection of DPFs. For the work reported here a Silicon Carbide DPF was used.

The engine was run at a number of constant speed and constant load operating points. As noted above, the and of ultimate burn off are particularly recordable at light to medium engine duty.

Up until now, many diesel trap devices have required complicated devices to initiate and control the exotherm of trap regeneration. In some instances, the composition of the present invention can significantly reduce or eliminate the need for regeneration initiation and control devices. The need for energy input to initiate the regeneration can also be substantially reduced or eliminated for many engine designs. At conditions of medium to full engine load the trapping and regeneration mechanisms operate simultaneously giving excellent control of the particulate emissions from diesel exhaust.

Preferably, the composition of the present invention is designed to remain compatible with hydrocarbon fuels and remain stable up to the point of entry to the combustion zone.

Preferably the composition of the present invention is fuel-soluble or fuel miscible. This serves to reduce the complexity and cost of any on-board dosing device.

A further advantage of a highly preferred composition of the invention is that it can be supplied in concentrated form in a suitable solvent that is fully compatible with diesel and other hydrocarbon fuels, such that blending of fuel and additive may be more easily and readily carried out.

A further advantage of a highly preferred composition of the present invention is that it is at least resistant and preferably totally inert towards water leaching, thus providing a fuel additive that is compatible with the fuel handling, storage and delivery systems in common use. In particular, diesel fuel often encounters water, especially during delivery to the point of sale and so the composition of the present invention is not affected by the presence of that water.

Other advantages of the fuel additive in accordance engine was controlled by the test bench computer. Although testing was to be conducted at constant engine speed/load conditions, certain safeguards had to be built into the test program such that neither the DPF nor the engine were subjected to potentially harmful conditions.

After a 5 minute start-up stage the engine ran in a 2 stage loop where it was controlled to the constant speed/load conditions required, a loop counter was set to give the required overall test duration. During the constant speed/load stages, data logging of critical engine parameters and DPF temperatures was performed every minute, each log being the average of 1 Hz logging over the preceding 10 seconds. If, at the end of the test, the exhaust back pressure was above a pre-set limit, then the test sequence passed to a 'forced regeneration' stage before the engine was brought to idle and stopped. If at any time during the constant speed/load stages the exhaust pressure reached a predefined limit then the test sequence jumped to a 'forced regeneration' stage where, over 7 minutes 30 seconds the engine speed and load were increased to 3500 rev/min (rpm) and 110 Nm, respectively. During this stage, data logging rates were increased to every 10 seconds for engine parameters. If during the 'forced regeneration' stage the exhaust pressure dropped below a pre-set limit then the test sequence returned to the constant speed/load stage. If after 10 minutes the exhaust pressure had not fallen below the pre-set limit, then it was assumed that the DPF would not regenerate and the test was stopped. If at any time the DPF outlet temperature exceeded 750° C. the test sequence jumped to a 'safety stage', during which the engine speed and fuelling were controlled to 3000 rev/min and 5% rack respectively. When the DPF outlet temperature fell below 500° C. then the sequence returned to the constant speed/load stage. If after 5 minutes the temperature had not fallen sufficiently then it was assumed that there was a problem and the test was stopped.

From the pressure recordings of the above tests it was possible to determine the mean exhaust pressure prior to the DPF. It was also possible to determine the standard deviation of the exhaust pressure. Previous experience has shown that mean plus two times standard deviation of exhaust pressure is a good indication of DPF performance.

The following two tables (Tables I and II) indicate the mean exhaust pressure (Table I) and the mean plus two times standard deviation of exhaust pressure (Table II) as determined from testing at five distinct speed/load conditions with different ratios of iron and strontium-containing compounds (Examples 1–6). In each test the iron-containing compound used was ferrocene and the strontium-containing compound was that prepared by the reaction of $Sr(OH)_2.8H_2O$ with poly(butenyl)succinic anhydride prepared by the thermal maleinisation of BP Napvis X-10™ as described in WO-A-96/34075.

The synergistic nature of the iron/strontium mixtures in accordance with the invention (Examples 2–5) is clearly demonstrated.

TABLE I

| Mean pre-DPF exhaust pressure | | | | | | |
|---|---|---|---|---|---|---|
| Speed/load | Fe/Sr dose ppm m/m in fuel (Example No. in **bold**) | | | | | |
| rpm/Nm | 20/0 **1** | 18/2 **2** | 16/4 **3** | 14/6 **4** | 12/8 **5** | 0/20 **6** |
| 1260/5 | | 56 | 54 | 55 | 53 | 74 |
| 1550/10 | 108 | 75 | 73 | 74 | 100 | 131 |
| 1550/20 | 82 | 64 | 59 | 70 | | |
| 2710/30 | 152 | 128 | 125 | 122 | 121 | 150 |
| 3000/30 | 188 | 143 | 142 | 151 | 169 | |

TABLE II

| Mean plus 2σ pre-DPF exhaust pressure | | | | | | |
|---|---|---|---|---|---|---|
| Speed/load | Fe/Sr dose ppm m/m in fuel (Example No. in **bold**) | | | | | |
| rpm/Nm | 20/0 **1** | 18/2 **2** | 16/4 **3** | 14/6 **4** | 12/8 **5** | 0/20 **6** |
| 1260/5 | | 84 | 75 | 78 | 84 | 113 |
| 1550/10 | 173 | 109 | 102 | 109 | 162 | 321 |
| 1550/20 | 124 | 86 | 78 | 111 | | |
| 2710/30 | 203 | 167 | 157 | 165 | 152 | 220 |
| 3000/30 | 268 | 193 | 183 | 228 | 242 | |

EXAMPLE 7

Preparation of Sr Additive

A small sample of the poly(butenyl)succinic anhydride material used to prepare the Sr additive used in Examples 2–6 was titrated with standardised lithium methoxide solution. The estimate of anhydride content so obtained was used as the basis on which to charge a 25% excess of propan-2-ol based on the number of anhydride groups present within a reactor charge. The resulting mixture was heated at 85–90° C. for four hours. Monitoring of the infra-red spectrum indicated that after this time substantially all the anhydride groups had reacted. Unreacted propan-2-ol was removed by vacuum stripping. A small sample of the resulting material was then titrated against the standardised lithium methoxide solution. The acidity of the material was consistent with its formulation as the isopropyl alcohol hemi-ester of the succinic acid formed from the original anhydride. A Shellsol AB™ solution of the hemi-ester was then reacted with solid strontium hydroxide so as to provide a faintly cloudy solution containing 5 wt % strontium.

EXAMPLE 8

Engine Test

A fuel additive concentrate was prepared from Ferrosol T6™ (267 parts), a 5 wt % Sr-containing solution, prepared as in Examples 2–6 (80 parts) and additional Shellsol AB™ (53 parts). The fuel additive concentrate was added at a rate of 400 ppm m/m to base diesel from the same stock as used in previous examples and tested according to the methods previously described. Performance was compared to similarly prepared fuels containing either 20 ppm of iron as Ferrosol T6™ or 20 ppm Sr prepared as for Examples 2–6. The synergy between iron and strontium was again observed (see Tables III and IV below).

TABLE III

| Mean pre-DPF exhaust pressure | | | | |
|---|---|---|---|---|
| | Fe/Sr dose ppm m/m in fuel | | | |
| Speed/load rpm/Nm | 20/0 | 16/4 | 0/20 | 0/20 |
| 3000/30 | 147 | 119 | 156 | 169 |

TABLE IV

| Mean plus 2σ pre-DPF exhaust pressure | | | | |
|---|---|---|---|---|
| | Fe/Sr dose ppm m/m in fuel | | | |
| Speed/load rpm/Nm | 20/0 | 16/4 | 0/20 | 0/20 |
| 3000/30 | 273 | 165 | 278 | 294 |

EXAMPLE 9

Engine Test

A fuel additive concentrate was prepared from Ferrosol T9™ (an experimental material provided by Centec) and containing 9 wt % dissolved iron (177 parts) a 5 wt % Sr-containing solution, prepared as in Example 7 (80 parts) and additional Shellsol AB™ (43 parts). The fuel additive concentrate was added at a rate of 300 ppm m/m to base diesel from the same stock as used in previous examples and tested according to the methods previously described. Performance was compared to similarly prepared fuels containing either 20 ppm of iron as Ferrosol T6™ or 20 ppm Sr prepared as in Example 7. The synergy between iron and strontium was again observed (see Tables V and VI below).

TABLE V

| Mean pre-DPF exhaust pressure | | | |
|---|---|---|---|
| | Fe/Sr dose ppm m/m in fuel | | |
| Speed/load rpm/Nm | 20/0 | 16/4 | 0/20 |
| 2710/30 | 115 | 112 | 143 |
| 3000/30 | 152 | 127 | 152 |

TABLE VI

| Mean plus 2σ pre-DPF exhaust pressure | | | |
|---|---|---|---|
| | Fe/Sr dose ppm m/m in fuel | | |
| Speed/load rpm/Nm | 20/0 | 16/4 | 0/20 |
| 2710/30 | 189 | 144 | 220 |
| 3000/30 | 284 | 190 | 237 |

EXAMPLE 10

Engine Test

A sample of iron tris(pentane-2,4-dionate)[14024-18-1] was obtained commercially. Sufficient material to treat each of two 205 liter drums of diesel with 20 and 16 ppm of iron, respectively, was dissolved in a 10 liter sample taken from each drum. To the second drum was also added sufficient additive prepared as detailed in Example 7 to provide 4 ppm of Sr. The more discriminating tests using the procedures of Examples 2–6, i.e. those at 2710 rpm 30 Nm and 3000 rpm 30 Nm were used to demonstrate the synergistic effect of the 4:1 Fe:Sr composition. Results for 20 ppm Sr alone are taken from Example 9.

TABLE VII

| Mean pre-DPF exhaust pressure | | | |
|---|---|---|---|
| | Fe/Sr dose (ppm m/m) | | |
| Speed/load rpm/Nm | 20/0 | 16/4 | 0/20 |
| 2710/30 | 134 | 127 | 143 |
| 3000/30 | 145 | 128 | 152 |

TABLE VIII

| Mean plus 2σ pre-DPF exhaust pressure | | | |
|---|---|---|---|
| | Fe/Sr dose (ppm m/m) | | |
| Speed/load rpm/Nm | 20/0 | 16/4 | 0/20 |
| 2710/30 | 170 | 154 | 220 |
| 3000/30 | 201 | 163 | 237 |

EXAMPLE 11

Engine Test

A sample of $Sr(TMHD)_2.3DMI$ was prepared as detailed in WO 96/34074. Sufficient of the material was dissolved in samples taken from two 205 liter drums of fuel so as to provide Sr concentrations of 4 and 20 ppm m/m, respectively. That containing 4 ppm Sr was additionally treated with sufficient Ferrosol T6™ to provide 16 ppm m/m iron in the fuel. The discriminating 2710/30 and 3000/30 speed/load conditions from Examples 2–6 were used to demonstrate the synergistic benefit of the 4:1 Fe:Sr Mixture.

Spontaneous regeneration of the DPF is not always observed at exactly the same exhaust back pressure under the conditions of this test. A limited number of excursions to higher pressure, whether through delayed onset of regeneration or 'noise' from the pressure sensor can distort the mean back-pressure reading. The mean plus 2σ is less affected and provides a more reliable picture of additive/DPF performance.

TABLE IX

| Mean pre-DPF exhaust pressure | | | |
|---|---|---|---|
| | Fe/Sr dose (ppm m/m) | | |
| Speed/load rpm/Nm | 20/0 | 16/4 | 0/20 |
| 2710/30 | 119 | 141 | 173 |
| 3000/30 | 147 | 147 | 200 |

TABLE X

| Mean plus 2σ pre-DPF exhaust pressure | | | |
|---|---|---|---|
| | Fe/Sr dose (ppm m/m) | | |
| Speed/load rpm/Nm | 20/0 | 16/4 | 0/20 |
| 2710/30 | 185 | 159 | 252 |
| 3000/30 | 273 | 170 | 336 |

EXAMPLE 12

Engine Test

A sample of $Ca(TMHD)_2.2DMI$ was prepared as set out in WO 96/34074. Sufficient of the material was dissolved in samples taken from two 205 liter drums of fuel so as to provide Ca concentrations of 4 and 20 ppm m/m, respectively. That containing 4 ppm Ca was additionally treated with sufficient Ferrosol T6™ to provide 16 ppm m/m iron in the fuel. The discriminating 2710/30 and 3000/30 speed/load conditions from Examples 2–6 were used to demonstrate the synergistic benefit of a 4:1 Fe:Ca mixture.

TABLE XI

| Mean pre-DPF exhaust pressure | | | |
|---|---|---|---|
| | Fe/Ca dose (ppm m/m) | | |
| Speed/load rpm/Nm | 20/0 | 16/4 | 0/20 |
| 2710/30 | 119 | 123 | 149 |
| 3000/30 | 147 | 128 | 194 |

TABLE XII

| Mean plus 2σ pre-DPF exhaust pressure | | | |
|---|---|---|---|
| | Fe/Ca dose (ppm m/m) | | |
| Speed/load rpm/Nm | 20/0 | 16/4 | 0/20 |
| 2710/30 | 185 | 155 | 225 |
| 3000/30 | 273 | 170 | 371 |

What is claimed is:

1. A method of regenerating a particulate filter trap, the method comprising adding to a fuel prior to or during combustion thereof a fuel additive composition comprising at least one iron-containing fuel soluble or fuel dispersible species in synergistic combination with at least one alkaline earth group metal-containing fuel soluble or fuel dispersible species optionally together with a fuel-soluble, carrier liquid, wherein the said alkaline earth group metal-containing species comprises strontium and/or calcium and wherein the ratio by weight of iron to said alkaline earth group metal is from 10:1 to 5:4 and further comprising combusting the fuel/fuel additive mixture and passing the combusted gases through the trap to collect particulates which are then combusted.

2. A method as claimed in claim 1 wherein the composition comprises a single iron-containing fuel soluble or fuel dispersible species together with a single alkaline earth group metal-containing fuel soluble or fuel dispersible species.

3. A method as claimed in claim 1 wherein the iron and alkaline earth group metal-containing species are the sole metal-containing species present in the composition.

4. A method as claimed in claim 1 wherein the or at least one of the iron-containing species is an organometallic complex of iron.

5. A method as claimed in claim 1 wherein the or at least one of the iron-containing species is selected from ferrocene, substituted ferrocenes, iron naphthenate, iron succinates, stoichiometric or over-based iron soaps, iron picrate, iron carboxylate and iron β-diketonate complexes.

6. A method as claimed in claim 5 wherein the or at least one of the iron-containing species is an iron carboxylate.

7. A method as claimed in claim 5 wherein the or at least one of the iron-containing species is an iron α-poly(alkenyl) succinate or 2-ethylhexanoate.

8. A method as claimed in claim 5 wherein the or at least one of the iron-containing species is a ferrocene or a substituted ferrocene.

9. A method as claimed in claim 5 wherein the or at least one of the iron-containing species is of the formula $M(R)_x.nL$ wherein M is an iron cation; R is the residue of an organic compound RH in which R is an organic group containing an active hydrogen atom H replaceable by iron and attached to an O, S, P, N or C atom in the group R; x is 2 or 3; n is 0 or a positive integer indicating the number of donor ligand molecules forming a dative bond with the iron cation; and L is a Lewis base.

10. A method as claimed in claim 9 wherein R and L are present in the same molecule.

11. A method as claimed in claim 1 wherein the or at least one of the alkaline earth group metal-containing species is an organometallic complex of strontium or calcium.

12. A method as claimed in claim 11 wherein said organometallic complex is selected from the group consisting of a phenoxide, a β-diketonate and a stoichiometric or over-based carboxylate or sulfonate soaps.

13. A method as claimed in claim 1 wherein the or at least one of the alkaline earth group metal-containing species is of the formula $M(R)_2.nL$ wherein M is a strontium or calcium cation; and R is the residue of an organic compound RH in which R is an organic group containing an active hydrogen atom H replaceable by the strontium or calcium and attached to an O, S, P, N or C atom in the group R; n is 0 or a positive integer indicating the number of donor ligand molecules forming a dative bond with the calcium or strontium; and L is a Lewis base.

14. A method as claimed in claim 13 wherein said alkaline earth group metal-containing species is an α-poly(alkenyl) substituted succinate salt of strontium or calcium, or a complex thereof.

15. A method as claimed in claim 14 wherein said alkaline earth group metal-containing species is a bis poly(butenyl) saccinate salt of strontium or calcium.

16. A method as claimed in claim 13 wherein said alkaline earth group metal-containing species is the reaction product of strontium or calcium hydroxide and a hemi-ester of a poly(alkenyl) succinate.

17. A method as claimed in claim 16 wherein said hemi-ester is prepared from the reaction product of maleic anhydride with poly(isobutene) or poly (butene) and isopropyl alcohol.

18. A method as claimed in claim 1 wherein said ratio is from 6:1 to 5:4.

19. A method as claimed in claim 1 wherein said ratio is about 4:1.

20. A method as claimed in claim 1 wherein the total concentration of said iron and said alkaline earth metal-containing species is in the range from 5 to 90% by weight of the total composition.

21. A method as claimed in claim 20 wherein said range is from 40 to 60% by weight of the total composition.

22. A method as claimed in any claim 1 wherein said particulate filter trap is a diesel particulate filter trap.

23. A method as claimed in claim 1 wherein the total concentration of the iron and the alkaline earth metal added to the fuel prior to combustion is 100 ppm or less.

24. A method as claimed in claim 23 wherein the total concentration of the iron and the alkaline earth metal in the fuel prior to combustion is 20 ppm or less.

* * * * *